US009666355B1

(12) United States Patent
Folker et al.

(10) Patent No.: US 9,666,355 B1
(45) Date of Patent: May 30, 2017

(54) COMMON MODE INDUCTOR ASSEMBLY WITH MAGNETIC I BAR DEFINED LEAKAGE PATH

(71) Applicant: Universal Lighting Technologies, Inc., Madison, AL (US)

(72) Inventors: Donald Folker, Madison, AL (US); Brandon Dyer, Huntsville, AL (US); Mike LeBlanc, Huntsville, AL (US)

(73) Assignee: UNIVERSALE LIGHTING TECHNOLOGIES, INC., Madison, AL (US)

( * ) Notice: Subject to any disclaimer, the term of this patent is extended or adjusted under 35 U.S.C. 154(b) by 0 days.

(21) Appl. No.: 14/827,403

(22) Filed: Aug. 17, 2015

Related U.S. Application Data

(60) Provisional application No. 62/038,681, filed on Aug. 18, 2014.

(51) Int. Cl.

| | |
|---|---|
| ***H01F 27/24*** | (2006.01) |
| ***H01F 27/30*** | (2006.01) |
| ***H01F 27/33*** | (2006.01) |
| ***H01F 41/02*** | (2006.01) |
| ***H01F 27/00*** | (2006.01) |
| ***H01F 27/32*** | (2006.01) |

(52) U.S. Cl.
CPC ..... *H01F 27/33* (2013.01); *H01F 27/006* (2013.01); *H01F 27/24* (2013.01); *H01F 27/325* (2013.01); *H01F 41/02* (2013.01)

(58) Field of Classification Search
CPC ..... H01F 2005/022
USPC ..... 336/198
See application file for complete search history.

(56) References Cited

U.S. PATENT DOCUMENTS 2,561,855 A * 7/1951 Gould ..... H01F 38/10 315/280
4,916,424 A * 4/1990 Kijima ..... H01F 27/325 336/160

* cited by examiner

*Primary Examiner* — Elvin G Enad
*Assistant Examiner* — Ronald Hinson
(74) *Attorney, Agent, or Firm* — Patterson Intellectual Property Law, P.C.; Mark J. Patterson; Jerry Turner Sewell

(57) ABSTRACT

A common mode inductor includes a bobbin with two windings. A first winding is positioned between a first end flange and a first offset flange. A second winding is positioned between a second end flange and a second offset flange. The windings are spaced apart by a center section without windings. A pair of E-cores, each having a pair of outer legs and a center leg, are positioned in a passageway of the bobbin such that the center leg of each E-core is surrounded by a respective one of the two windings. An I-bar is positioned in the center section of the bobbin between the two offset flanges with the I-bar perpendicular to the outer legs and the center legs of the two E-cores. The I-bar core increases leakage inductance between the two windings to improve the suppression of electromagnetic interference caused by common mode noise in the two windings.

4 Claims, 9 Drawing Sheets

COMMON MODE INDUCTOR ASSEMBLY WITH MAGNETIC I BAR DEFINED LEAKAGE PATH

CROSS-REFERENCES TO RELATED APPLICATIONS

This application claims benefit of the following patent application which is hereby incorporated by reference: U.S. Provisional Patent Application No. 62/038,681 filed Aug. 18, 2014, entitled "Common Mode Inductor Assembly with Magnetic I-Bar Defined Leakage Path."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Common mode chokes (inductors) are four-terminal devices with different common mode and differential mode characteristics. Common mode chokes are used in electromagnetic interference (EMI) filters and other circuits to suppress unwanted high frequency noise without significantly affecting desired signals.

A typical configuration of a common mode choke includes a winding bobbin divided into three sections with a first outer section, a middle section and a second outer section. A first winding is wound about the first outer section of the bobbin. A second winding is wound about the second outer section of the bobbin. The middle section of the bobbin does not include a winding. The empty middle section creates spacing between the windings on the two outer sections. The spacing increases the leakage inductance between the two outer windings. In many applications, increasing the leakage inductance is desirable to suppress EMI differential noise. The leakage inductance can be further increased by increasing the distance between the two windings. However, increasing the spacing between the two outer windings is not always an option because the increased length of the bobbin may not be acceptable.

BRIEF SUMMARY OF THE INVENTION

An aspect of the invention disclosed herein is a common mode inductor which includes a bobbin with two windings. A first winding is positioned between a first end flange and a first offset flange. A second winding is positioned between a second end flange and a second offset flange. The first and second windings are spaced apart by a center section without windings. A pair of E-cores, each having a pair of outer legs and a center leg, are positioned in a passageway of the bobbin such that the center leg of each E-core is surrounded by a respective one of the two windings. An I-bar is positioned in the center section of the bobbin between the two offset flanges with the I-bar perpendicular to the outer legs and the center legs of the two E-cores. The I-bar core increases leakage inductance between the two windings to improve the suppression of electromagnetic interference caused by common mode noise in the two windings.

Another aspect in accordance with embodiments disclosed herein is a common mode inductor having a bobbin with a first outer flange, a second outer flange, a first offset flange and a second offset flange. The first offset flange is spaced apart from the first outer flange to form a first winding section having a first winding wound thereon. The second offset flange is spaced apart from the second outer flange to form a second winding section having a second winding wound thereon. The second offset flange is spaced apart from the first offset flange to form a middle section, which separates the first winding from the second winding. A passageway extends through the bobbin from the first outer flange to the second outer flange. The common mode inductor further includes a first E-core and a second E-core. Each E-core has a center leg and first and second outer legs. The E-cores are positioned on the bobbin with the respective center leg of each E-core inserted into the passageway with a respective end surface of the center leg of the first E-core juxtaposed with a respective end surface of the center leg of the second E-core to form a gap between the two surfaces. The common mode inductor also has an I-bar positioned in the middle section of the bobbin. The I-bar spans from the first outer leg to the second outer leg of each E-core. Each of the first outer leg, the second outer leg and the center leg of the first E-core and the second E-core has an upper surface. The I-bar has a lower surface. In certain embodiments, the lower surface of the I-bar contacts the upper surfaces of the first and second outer legs and the center legs of the first and second E-cores. In other embodiments, the lower surface of the I-bar is parallel to and spaced apart from the upper surfaces of the first and second outer legs and the center legs of the first and second E-cores. The I-bar provides a magnetic path from the center legs to the outer legs of the E-cores to increase the leakage inductance of the common mode inductor.

Another aspect in accordance with embodiments disclosed herein is a common mode inductor including a bobbin having a passageway. A first winding and a second winding are wound around the passageway with the first winding spaced apart from the second winding. The common mode inductor further includes a first E-core and a second E-core. Each E-core has respective first and second outer legs and has a respective middle leg. The middle legs of the E-cores are inserted into the passageway of the bobbin with respective end surfaces of the middle legs juxtaposed and spaced apart by a distance to form a gap therebetween. The common mode inductor further includes an I-bar positioned between the first winding and the second winding. The I-bar is oriented perpendicular to the middle legs and outer legs of the first and second E-cores. Each of the first and second outer legs and the center leg of the first E-core and the second E-core has an upper surface, and the I-bar has a lower surface. In certain embodiments, the lower surface of the I-bar contacts the upper surfaces of the first and second outer legs and the center legs of the first and second E-cores. In other embodiments, the lower surface of the I-bar is parallel to and spaced apart from the upper surfaces of the first and second outer legs and the center legs of the first and second E-cores. The I-bar provides a magnetic path from the center legs to the outer legs of the E-cores to increase the leakage inductance of the common mode inductor.

Another aspect in accordance with embodiments disclosed herein is a method of increasing the leakage inductance of a common mode inductor. The method includes providing a bobbin having a passageway with first and second windings wound around the passageway. Each winding is connectable to respective first and second electrical conductors subject to common mode noise. The method further includes positioning respective middle legs of first and second E-cores in the passageway with each middle leg encircled by a respective one of the first and second windings. Each E-core also has a respective pair of outer legs. The method further comprises positioning an I-bar across the outer legs and the middle leg of each E-core to provide an additional magnetic path between the middle legs and the outer legs. The additional magnetic path increases the leakage inductance of the common mode inductor. In accordance with aspects of the method, each of the outer legs and the center leg of the first E-core and the second E-core has an upper surface, and the I-bar has a lower surface. In one aspect of the method, the method further includes positioning the lower surface of the I-bar in contact with the upper surfaces of the outer legs and the center legs of the first and second E-cores. In another aspect of the method, the method further includes positioning the lower surface of the I-bar parallel to and spaced apart from the upper surfaces of the first and second outer legs and the center legs of the first and second E-cores.

DETAILED DESCRIPTION OF THE INVENTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Figure 1:
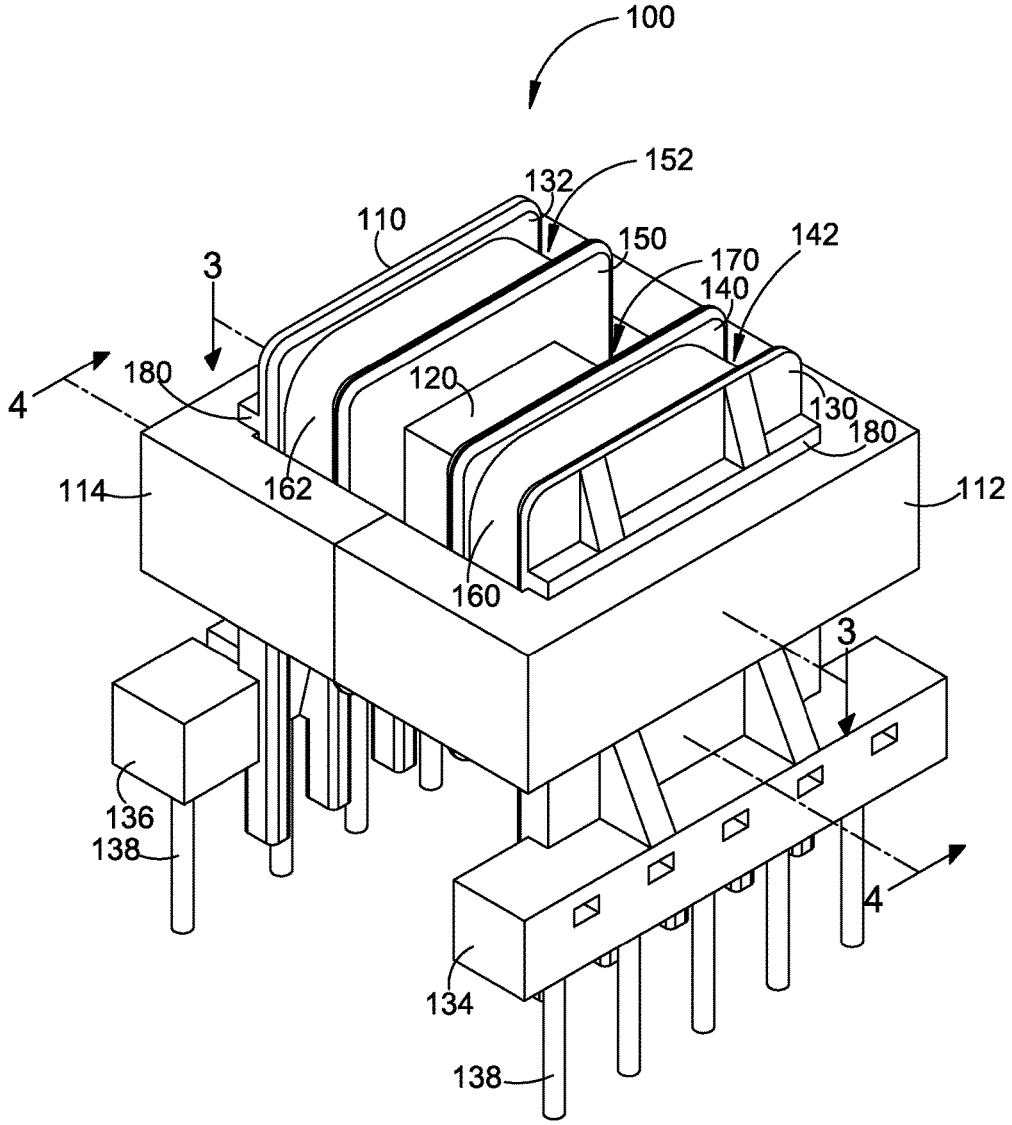
FIG. 1 (Prior Art)
FIG. 1 illustrates a perspective view of a conventional common mode choke.
Figure 2:
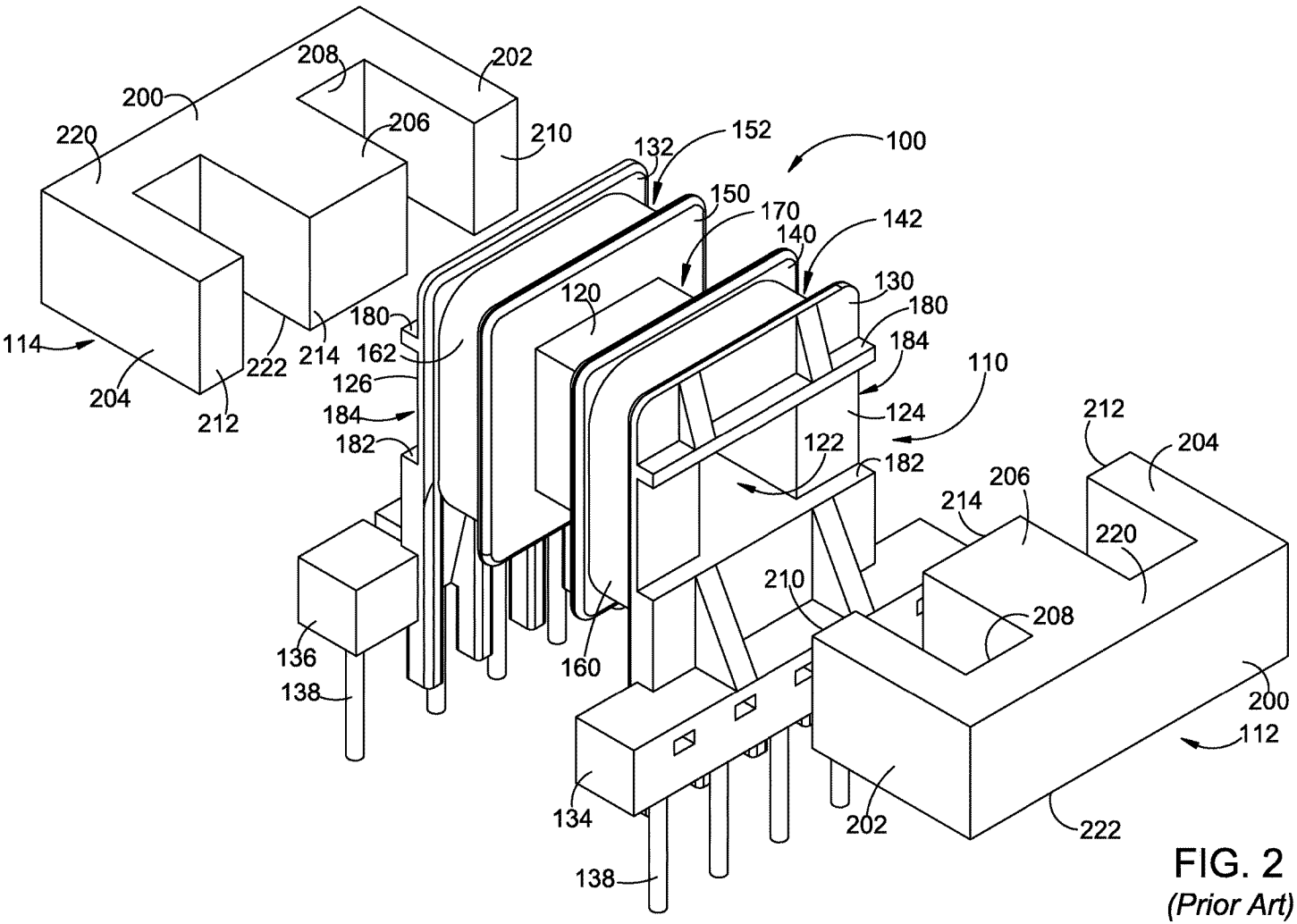
FIG. 2 (Prior Art)
FIG. 2 illustrates an exploded perspective view of the common mode choke of FIG. 1.
Figure 3:
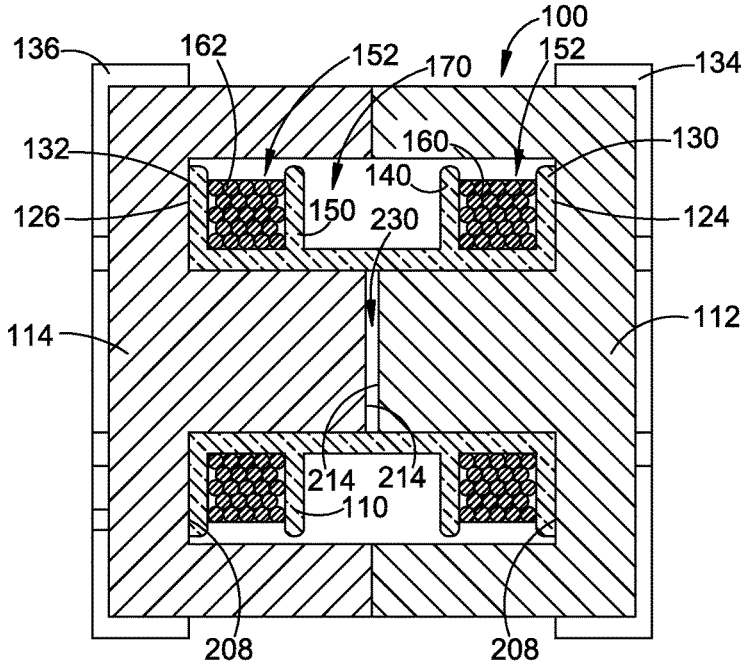
FIG. 3 (Prior Art)
FIG. 3 illustrates a cross-sectional plan view of the choke of FIG. 1 taken along the line 3-3 in FIG. 1.
Figure 4:
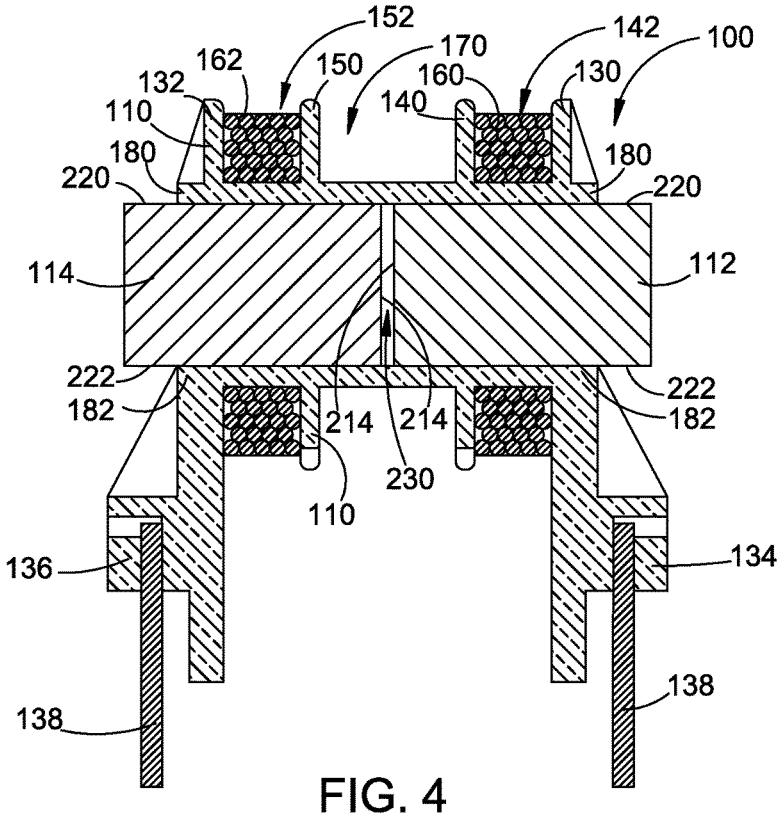
FIG. 4 (Prior Art)
FIG. 4 illustrates a cross-sectional side elevational view of the common mode choke of FIG. 1 taken along line 4-4 in FIG. 1.

FIG. 1 illustrates a perspective view of a conventional common mode choke 100. FIG. 2 illustrates an exploded perspective view of the choke of FIG. 1. FIG. 3 illustrates a cross-sectional plan view of the choke of FIG. 1 taken along line 3-3 in FIG. 1. FIG. 4 illustrates a cross-sectional side elevational view of the common mode choke of FIG. 1 taken along the line 4-4 in FIG. 1. The conventional common mode choke 100 includes a bobbin 110, a first E-core 112 and a second E-core 114.

The bobbin 110 has a central body portion 120 which surrounds a central passageway 122 (FIG. 2). The central passageway 122 extends from a first end 124 of the bobbin to a second end 126 of the bobbin. In the illustrated embodiment, the opening into the central passageway 122 has a generally rectangular profile (e.g., a square profile). In the illustrated embodiment, the central passageway 122 has an internal width of approximately 0.24 inches and an internal height of approximately 0.24 inches. In the illustrated embodiment, the central passageway 122 has an upper wall, a lower wall and two side walls with each of the walls having a thickness of approximately 0.303 inches. The profile of the central passageway 122 may differ in other embodiments (e.g., non-square rectangular, circular, oval, or the like)

The bobbin 110 further includes a first end flange 130 and a second end flange 132 that surround the central body portion 120 proximate to the first end 124 and the second end 126, respectively. The first end flange 130 is attached to a first connector rail 134. The second end flange 132 is connected to a second connector rail 136. A plurality of connector pins 138 extend from each of the connector rails.

The bobbin 110 further has a first offset flange 140, which is offset from the first end flange 130. A first winding section 142 is defined around the body portion between the first end flange 130 and the first offset flange 140. The bobbin further includes a second offset flange 150, which is offset from the second end flange 132. A second winding section 152 is defined around the body portion between the second end flange 132 and the second offset flange 150. In the illustrated embodiment, the each offset flange is offset from the respective end flange by approximately the same distance such that the first and second winding sections have substantially the same width between the flanges on either side of the respective winding section. For example, in one embodiment, each winding section has a width of approximately 0.115 inches between adjacent flange surfaces.

The bobbin 110 further has a first winding 160 and a second winding 162. The first winding 160 is wound around the body portion 120 of the bobbin in the first winding section 142. The second winding 162 is wound around the body portion in the second winding section 152. Each winding has a plurality of turns of copper wire, wherein the number of turns is selected to provide a selected inductance in each winding. Each end (not shown) of each winding is connected in a conventional manner to a respective one of a plurality of connector pins 138 on the first and second connector rails, 134, 136. For example, the ends of the first winding 160 are connected to two pins on the first connector rail 134, and the ends of the second winding 162 are connected to two pins on the second connector rail 136.

The bobbin 110 further includes a middle section 170 defined between the first offset flange 140 and the second offset flange 150. The middle section 170 does not include a winding. The middle section 170 spaces the first winding 160 apart from the second winding 162. In the illustrated embodiment, the middle section 170 has a width of approximately 0.202 inches between the two offset flanges. The overall spacing between the first winding 160 and the second winding 162, which includes the width of the middle section 170 and the thicknesses of the first and second offset flanges, is approximately 0.26 inches.

Each of the first end flange 130 and the second end flange 132 supports an upper ledge 180 and a lower ledge 182. The upper ledge 180 extends outward from the respective flange immediately above the opening into the central passageway 122. In the illustrated embodiment, the upper ledge 180 extends outward from the flange approximately 0.04 inches and has a vertical thickness of approximately 0.03 inches. The lower ledge extends outward from the respective flange approximately 0.04 inches and has a vertical thickness of approximately 0.194 inches such that the lower ledge of each flange extends downward to intersect the respective connector rail 134, 136. The spacing between the upper ledge and the lower ledge forms a core receiving channel 184 that extends horizontally across the face of the flange with a vertical height of approximately 0.24 inches.

Each of the first E-core 112 and the second E-core 114 is formed of a ferrite material or other suitable ferromagnetic material. Each E-core 114 has a base portion 200, a first outer leg 202, a second outer leg 204, and a center leg 206. The three legs extend perpendicularly from an inner face 208 of the base portion. The first outer leg 202 has an outer leg length from the inner face of the base portion to a first outer leg face 210. The second outer leg 204 has an outer leg length from the inner face of the base portion to a second outer leg face 212. The center leg 206 has a center leg length from the inner face of the base portion to a center leg face 214. In the illustrated embodiment, each of the first outer leg 202 and the second outer leg 204 has a height that is substantially equal to the height of the center leg such that each E-core has a generally planar upper surface 220 and a generally planar lower surface 222. In the illustrated embodiment, each E-core has a height of approximately 0.24 inches between the lower surface and the upper surface. In the illustrated embodiment, the center core leg of each E-core has a width of approximately 0.24 inches such that the center leg has a substantially square profile with dimensions that match the dimensions of the profile of the central passageway 122. Each of the two outer legs of each E-core has a width of approximately 0.107 inches.

In the illustrated embodiment, the first outer leg length and the second outer leg length are substantially equal, and the center leg length is shorter by a selected offset distance. When the center legs 206 of the two E-cores 112, 114 are positioned in the central passageway 122 of the bobbin 110 from opposite ends of the central passageway, the first and second outer leg faces 210, 212 of the first E-core meet the second and first outer leg faces 212, 210 of the second E-core. The center leg faces 214 of the two E-cores are juxtaposed within the central passageway 122. The center leg faces are spaced apart by approximately twice the offset distance to form a central gap 230 as shown in the cross-sectional plan view of FIG. 3 and in the cross-sectional side elevational view in FIG. 4. The central gap 230 is aligned with the middle of the unwound middle section 170 of the bobbin. Furthermore, the lengths of the outer core legs are selected such that when the outer leg faces are abutting, the inner faces 208 of the two E-cores are positioned in the core receiving channels 184 of the first end flange 130 and the second end flange 132. Although not shown in FIGS. 1-3, the two E-cores are secured to each other by gluing the abutting outer leg faces, by taping around the combined outer perimeter of the two E-cores, or by other suitable securing techniques.

The illustrated common mode choke 100 operates in a conventional manner. The two windings 160, 162 have the same number of turns and are wound around the respective winding sections 142, 152. Accordingly, the two windings are wound around the center legs 206 of the two E-cores 112, 114 within the central passageway 122. The windings are electrically connected to the a pair of power lines (not shown), for example, such that the line current in the first winding generates magnetic flux in a first direction in the center legs and the line current in the second winding generates a magnetic flux in a second (opposite) direction in the center legs. The two fluxes are substantially equal in magnitude and opposite in phase and thus cancel each other leaving the core unbiased with respect to the expected currents in the power lines. On the other hand, common node noise, which affects both power lines approximately the same and which passes through the windings in the same direction, generates magnetic fluxes in the same directions in the center legs. This causes the magnetic fluxes produced by the two windings in response to common mode noise to reinforce each other. Accordingly, the common mode choke has a large inductance with respect to the common mode noise.

The conventional common mode choke 100 of FIGS. 1-3 also provides EMI differential noise suppression because of leakage inductance between the first winding 160 and the second winding 162. Increasing the leakage inductance can further suppress EMI differential noise. For example, the leakage inductance can be increased by increasing the spacing between the first and second windings. In the embodiment of FIGS. 1-3, the spacing is increased by including the unwound (empty) middle section 170 between the first and second windings. Although the leakage inductance can be further increased by further increasing the spacing between the first and second windings, additional spacing increases the overall size of the common mode chokes. The increase in overall size is undesirable for many applications.

Figure 5:
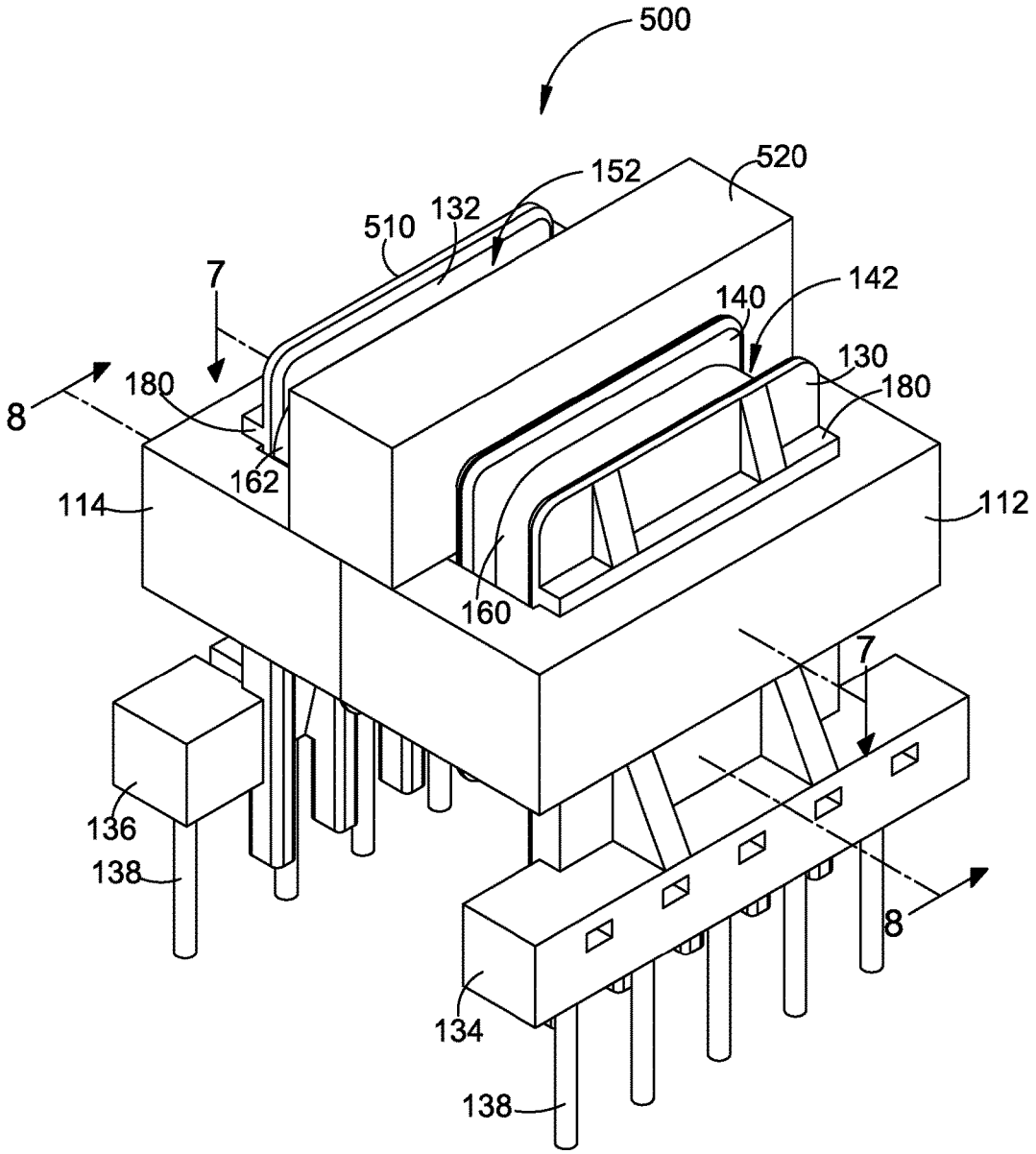
FIG. 5 illustrates a perspective view of an embodiment of a common mode choke in accordance with the present invention.
Figure 6:
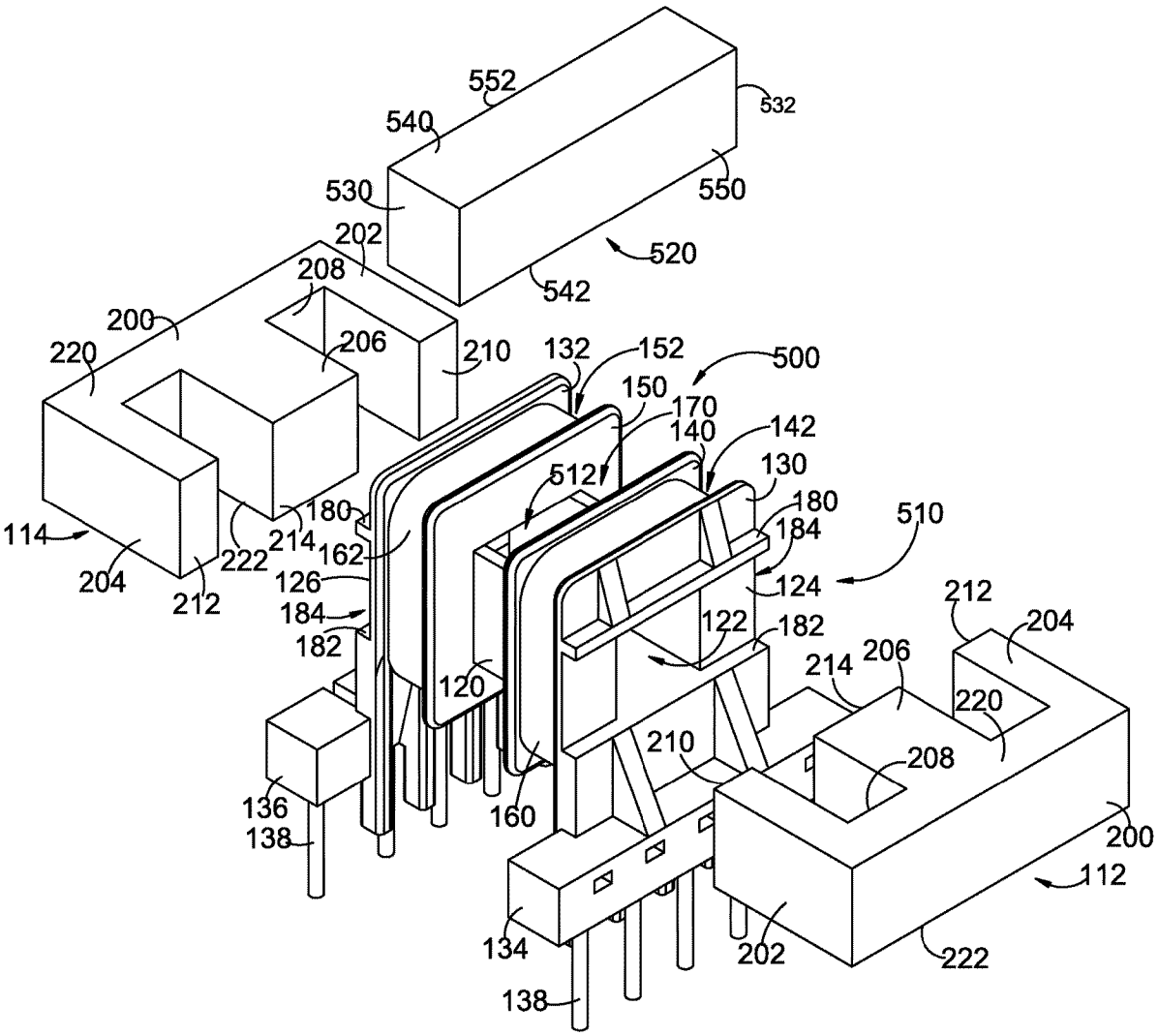
FIG. 6 illustrates an exploded perspective view of the choke of FIG. 5.
Figure 7:
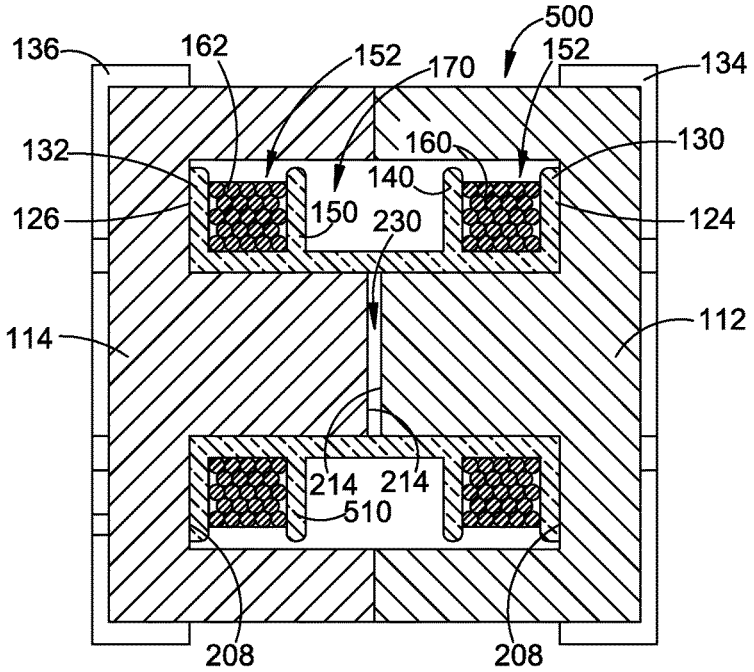
FIG. 7 illustrates a cross-sectional plan view of the choke of FIG. 5 taken along line 7-7 in FIG. 5.
Figure 8:
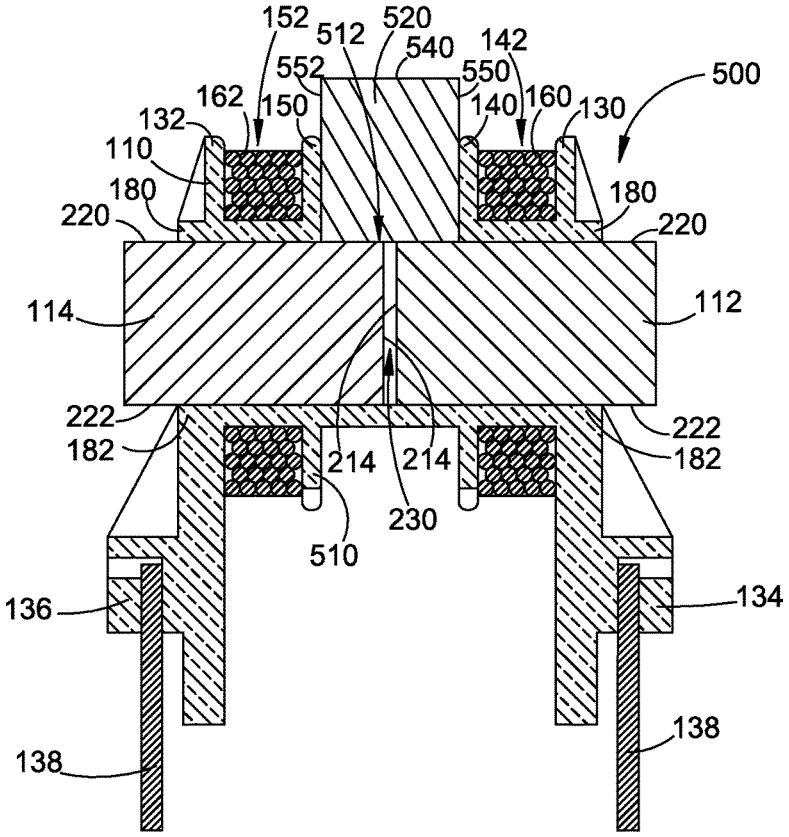
FIG. 8 illustrates a cross-sectional side elevational view of the common mode choke of FIG. 5 taken along line 8-8 in FIG. 5.
Figure 9:
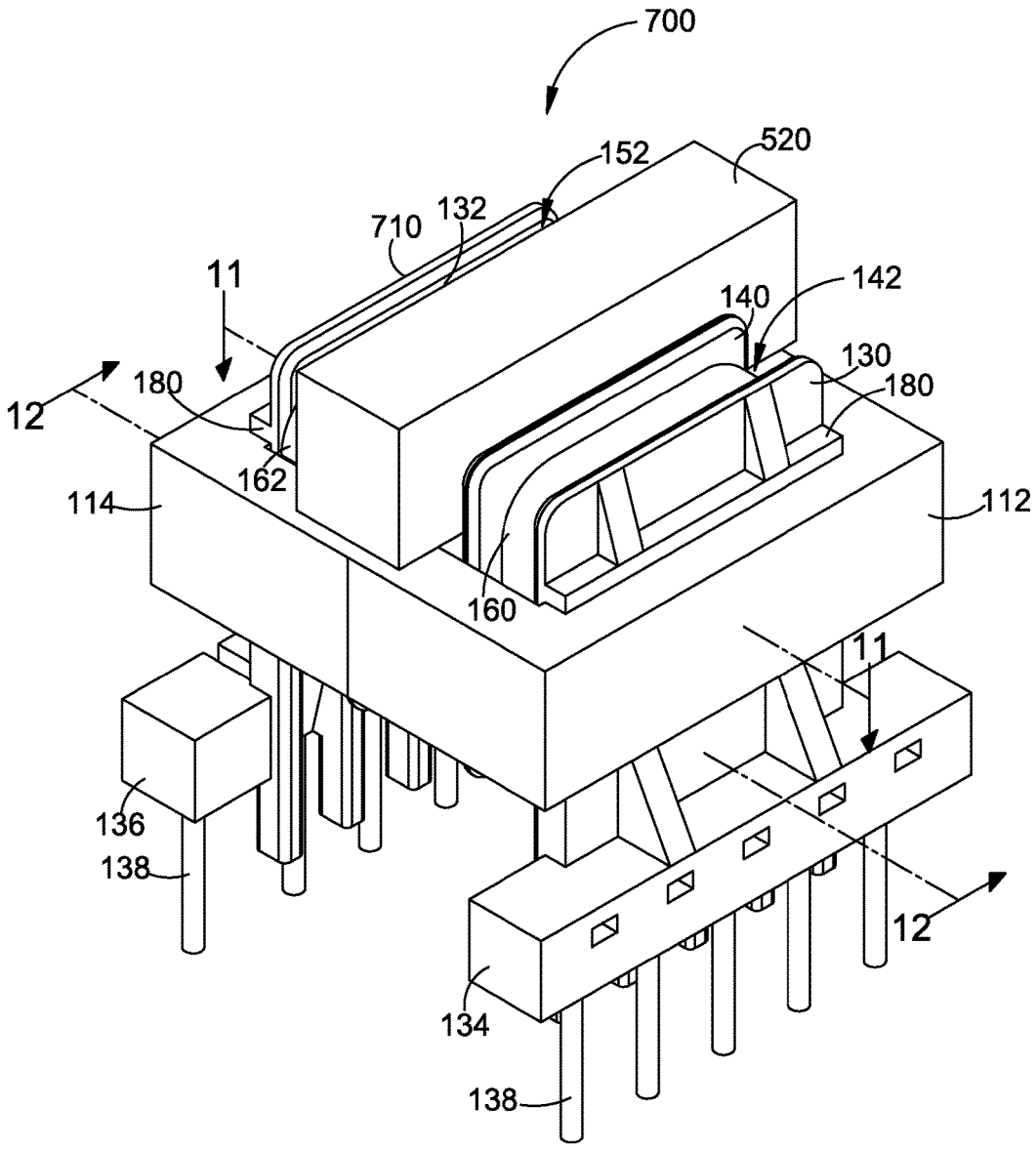
FIG. 9 illustrates a perspective view of another embodiment of a common mode choke in accordance with the present invention.
Figure 10:
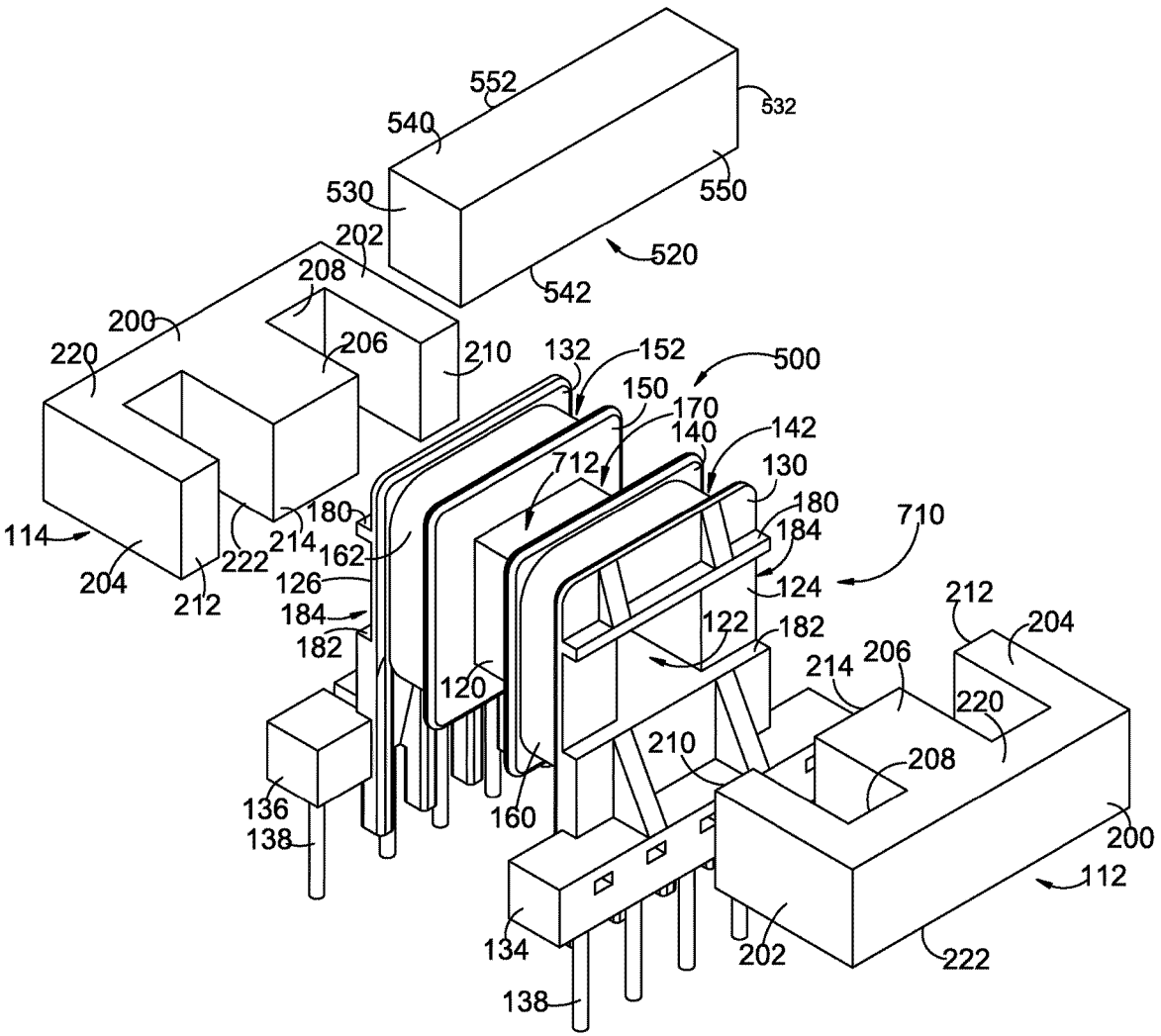
FIG. 10 illustrates an exploded perspective view of the choke of FIG. 9.
Figure 11:
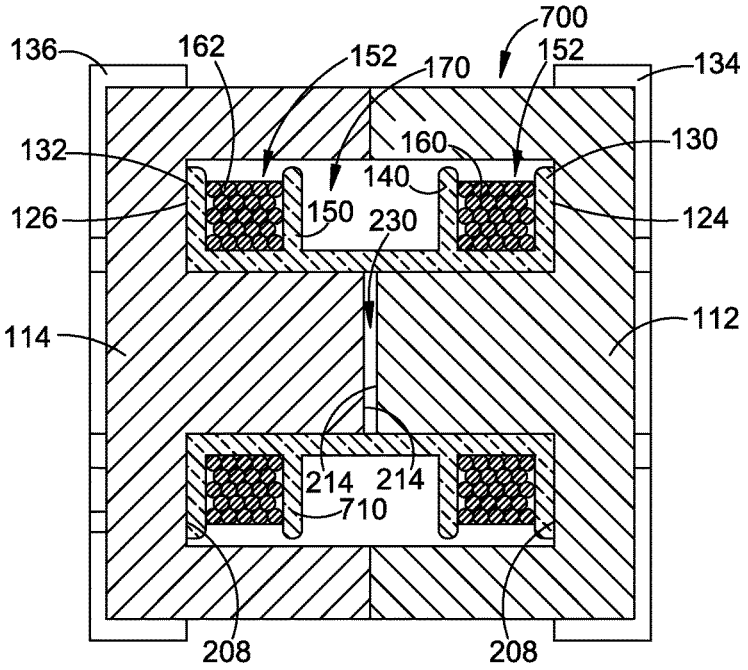
FIG. 11 illustrates a cross-sectional plan view of the choke of FIG. 9 taken along line 11-11 in FIG. 9.
Figure 12:
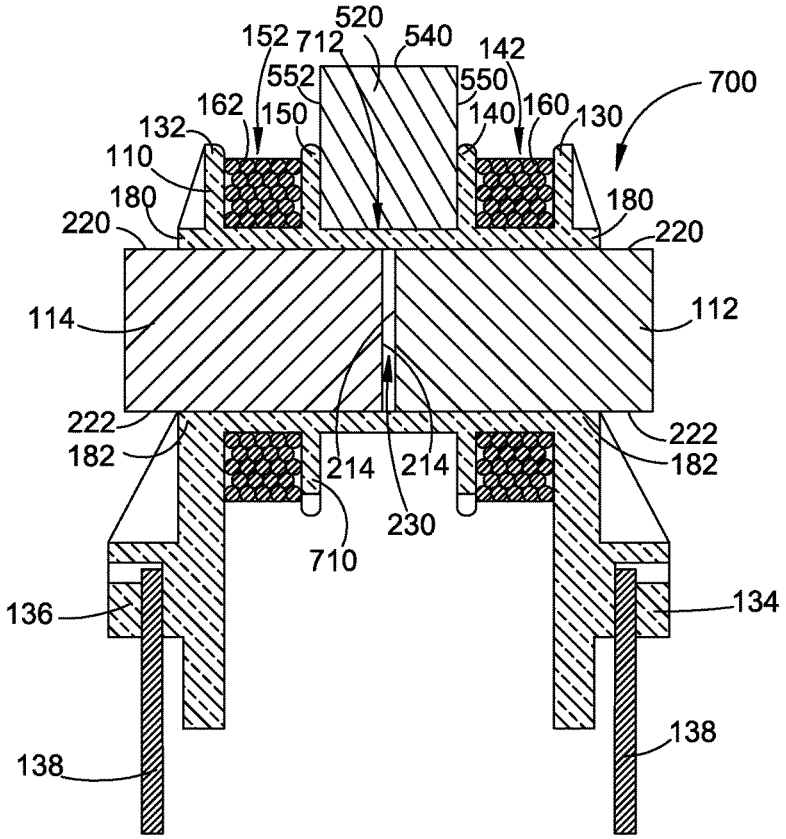
FIG. 12 illustrates a cross-sectional side elevational view of the common mode choke of FIG. 9 taken along line 12-12 in FIG. 9.

FIG. 5 illustrates a perspective view of a common mode choke 500, which has an increased leakage inductance to provide increased EMI differential noise suppression. FIG. 6 illustrates an exploded perspective view of the choke of FIG. 5. FIG. 7 illustrates a cross-sectional plan view of the choke of FIG. 5 taken along line 7-7 in FIG. 5. FIG. 8 illustrates a cross-sectional side elevational view of the common mode choke of FIG. 5 taken along line 8-8 in FIG. 5.

The common mode choke 500 of FIGS. 5-8 is similar in many aspects to the conventional common mode choke 100 of FIGS. 1-4; and like elements are numbered accordingly in FIGS. 5-8. Unlike the previous described conventional common mode choke 100, the improved common mode choke 500 includes a modified bobbin 510. The bobbin of FIGS. 5-8 is modified by removing a portion of the central body portion 120 within the middle section 170 between the first offset flange 140 and the second offset flange at the top of the central passageway 122. The removal of the portion of the central body portion creates an access opening 512 into the central passageway as shown in FIG. 6.

The common mode choke 500 further includes an additional ferromagnetic element 520, which is configured as an I-bar having a form of a rectangular parallelepiped. In one embodiment, the I-bar is formed from a ferrite material similar to the material of the two E-cores 112, 114. The I-bar may also include a distributed gap magnetic material such as, for example, iron powder. The I-bar is laid across the legs 202, 204, 206 of the two E-cores. Accordingly, the I-bar may be referred to as a crossbar.

As shown in FIG. 6, the I-bar 520 has a length between a first face 530 and a second face 532, which is selected to be approximately the length of the base portions 200 of the two E-cores 112, 114. The I-bar has a height between an upper surface 540 and a lower surface 542 selected to be approximately the same as the heights of the two E-cores in the illustrated embodiment. However, the height of the crossbar may be greater or smaller than the heights of the two E-cores. The I-bar has a width between a first side face 550 and a second side face 552. The width is substantially equal to the width of the unwound middle section 170 so that the I-bar fits snugly between the first offset flange 140 and the second offset flange 150. The I-bar may be press-fitted between the two offset flanges and secured between the two offset flanges by frictional engagement. Alternatively, or in addition to the frictional engagement, the I-bar may be secured in position by gluing, taping, or another suitable technique.

As shown in the perspective view of FIG. 6 and in the cross-sectional elevational side view of FIG. 8, the lower surface 542 of the I-bar 520 is positioned on the upper surfaces 220 of the legs 202, 204, 206 of the E-cores 112, 114. This is accomplished in the illustrated embodiment by removing a sufficient amount of the upper wall of the central passageway 122 to form the access opening 512 (FIG. 6) and a small amount of the side walls of the central passageway 122 so that the bottom surface of the I-bar contacts the upper surfaces of the legs.

FIGS. 9-12 illustrate an alternative embodiment of a common mode choke 700 similar to the common mode choke 500 of FIGS. 5-8 except that the bobbin 510 is replaced by a bobbin 710 in which an upper wall 712 of the passageway 122 is included in place of the access opening 512 of FIGS. 5-8. In the embodiment of FIGS. 9-12, the lower surface 542 of the I-bar 520 is spaced apart from the upper surface 220 of the legs 202, 204, 206 of the E-cores 112, 114 by a thickness of the upper wall of the passageway. The thickness of the upper wall can be selected to provide a desired gap between the bottom surface of the I-bar and the upper surface of the legs.

The I-bar 520 creates an additional leakage path between the outer legs 202, 204 and the center legs 206 of the two E-cores 112, 114 of the common mode choke 500 and the common mode choke 700. The additional leakage path increases the leakage inductance between the windings. The amount of increased leakage inductance can be regulated by varying the size of the air gap between the I-bar and the legs of the E-cores. For example, the common mode choke 500 has no air gap between the I-bar and the legs of the E-cores. The common mode choke 700 has an air gap that can be varied by varying the thickness of the upper wall 712 of the central passageway 122 between the lower surface of the I-bar and the upper surfaces of the center legs of the E-cores. The leakage inductance can also be varied by changing the size (e.g., the height of the I-bar, the width of the I-bar, or the height and the width of the I-bar). For example, increasing the height of the I-bar increases the leakage inductance. With various configurations of the I-bar, the leakage inductance of the improved common mode choke 500 of FIGS. 5-8 and the improved common mode choke 700 of FIGS. 9-12 can be varied from twice to ten times the amount of the leakage inductance of the conventional common mode choke 100 of FIGS. 1-4.

Although the I-bar 520 of the common mode choke 500 of FIGS. 5-8 and the common mode choke 700 of FIGS. 9-12 is shown as having the same width as the middle section 170 of the conventional common mode choke 100 of FIGS. 1-4, the I-bar of the improved common mode chokes can be narrower than shown in the illustrated embodiments and still provide increased leakage inductance with respect to the conventional common mode choke 100. Thus, the width of the middle section can be reduced to reduce the spacing between the first winding 142 and the second winding 152, thereby reducing the overall length of the improved common mode choke with respect to the conventional common mode choke.

The increased leakage inductance caused by the I-bar 520 of the common mode choke 500 of FIGS. 5-8 and the common mode choke 700 of FIGS. 9-12 may improve the performance of the common mode choke and also assists in suppressing EMI differential noise.

Although there have been described particular embodiments of the present invention of a new and useful "COMMON MODE INDUCTOR ASSEMBLY WITH MAGNETIC I BAR DEFINED LEAKAGE PATH," it is not intended that such references be construed as limitations upon the scope of this invention except as set forth in the following claims.

What is claimed is:

1. A common mode choke comprising:

a bobbin comprising a first outer flange, a second outer flange, a first offset flange spaced apart from first outer flange to form a first winding section having a first winding wound thereon, a second offset flange, the second offset flange spaced apart from the second outer flange to form a second winding section having a second winding wound thereon, the second offset flange spaced apart from the first offset flange to form a middle section, the middle section separating the first winding from the second winding, and a passageway extending through the bobbin from the first outer flange to the second outer flange;

a first E-core and a second E-core, each E-core having a center leg and first and second outer legs, the E-cores positioned on the bobbin with the respective center leg of each E-core inserted into the passageway with a respective end surface of the center leg of the first E core juxtaposed with a respective end surface of the center leg of the second E-core to form a gap between the two surfaces; and an I-bar positioned in the middle section of the bobbin, the I-bar spanning from the first outer leg to the second outer leg of each E-core;

wherein:

each of the first outer leg, the second outer leg and the center leg of the first E-core and the second E-core has an upper surface;

the I-bar has a lower surface; and the lower surface of the I-bar contacts the upper surfaces of the first and second outer legs and the center legs of the first and second E-cores.

2. A common mode choke comprising:

a bobbin comprising a first outer flange, a second outer flange, a first offset flange spaced apart from first outer flange to form a first winding section having a first winding wound thereon, a second offset flange, the second offset flange spaced apart from the second outer flange to form a second winding section having a second winding wound thereon, the second offset flange spaced apart from the first offset flange to form a middle section, the middle section separating the first winding from the second winding, and a passageway extending through the bobbin from the first outer flange to the second outer flange;

a first E-core and a second E-core, each E-core having a center leg and first and second outer legs, the E-cores positioned on the bobbin with the respective center leg of each E-core inserted into the passageway with a respective end surface of the center leg of the first E core juxtaposed with a respective end surface of the center leg of the second E-core to form a gap between the two surfaces; and an I-bar positioned in the middle section of the bobbin, the I-bar spanning from the first outer leg to the second outer leg of each E-core;

wherein:

each of the first outer leg, the second outer leg and the center leg of the first E-core and the second E-core has an upper surface;

the I-bar has a lower surface; and the lower surface of the I-bar faces and overlaps at least portions of each of the upper surfaces of the first and second outer legs and the center legs of the first and second E-cores, and the lower surface of the I-bar is parallel to the upper surfaces of the first and second outer legs and the center legs of the first and second E-cores, the lower surface of the I-bar spaced apart from the upper surfaces of the first and second outer legs and the center legs of the first and second E-cores in a direction perpendicular to the lower surface of the I-bar.

3. A common mode choke comprising:

a bobbin comprising a passageway with a first winding and a second winding wound around the passageway, the first winding spaced apart from the second winding;

first and second E-cores having respective first and second outer legs and having respective middle legs, the respective middle legs inserted into the passageway of the bobbin with respective end surfaces of the middle legs juxtaposed and spaced apart by a distance to form a gap therebetween; and an I-bar positioned between the first winding and the second winding with the I-bar oriented perpendicular to the middle legs and outer legs of the first and second E-cores;

wherein:

each of the first outer leg, the second outer leg and the center leg of the first E-core and the second E-core has an upper surface;

the I-bar has a lower surface; and the lower surface of the I-bar contacts the upper surfaces of the first and second outer legs and the center legs of the first and second E-cores.

4. A common mode choke comprising:

a bobbin comprising a passageway with a first winding and a second winding wound around the passageway, the first winding spaced apart from the second winding;

first and second E-cores having respective first and second outer legs and having respective middle legs, the respective middle legs inserted into the passageway of the bobbin with respective end surfaces of the middle legs juxtaposed and spaced apart by a distance to form a gap therebetween; and an I-bar positioned between the first winding and the second winding with the I-bar oriented perpendicular to the middle legs and outer legs of the first and second E-cores;

wherein:

each of the first outer leg, the second outer leg and the center leg of the first E-core and the second E-core has an upper surface;

the I-bar has a lower surface; and the lower surface of the I-bar faces and overlaps at least portions of each of the upper surfaces of the first and second outer legs and the center legs of the first and second E-cores, and the lower surface of the I-bar is parallel to the upper surfaces of the first and second outer legs and the center legs of the first and second E-cores, the lower surface of the I-bar spaced apart from the upper surfaces of the first and second outer legs and the center legs of the first and second E-cores in a direction perpendicular to the lower surface of the I-bar.

* * * * *